US005227808A

United States Patent [19]

Davis

[11] Patent Number: 5,227,808

[45] Date of Patent: Jul. 13, 1993

[54] WIDE-BAND L-BAND CORPORATE FED ANTENNA FOR SPACE BASED RADARS

[75] Inventor: Mark B. Davis, Chandler, Ariz.

[73] Assignee: The United States of America as represented by the Secretary of the Air Force, Washington, D.C.

[21] Appl. No.: 708,541

[22] Filed: May 31, 1991

[51] Int. Cl.[5] ..... H01Q 15/20

[52] U.S. Cl. ..... 343/915; 343/767

[58] Field of Search ..... 343/767, 770, 771, 700 MS, 343/881, 915

[56] References Cited

U.S. PATENT DOCUMENTS

| | | | |
|---|---|---|---|
| 4,482,900 | 11/1984 | Bilek et al. | 343/915 |
| 4,766,440 | 8/1988 | Gegan | 343/767 |
| 4,769,647 | 9/1988 | Herbig et al. | 343/915 |
| 4,843,403 | 6/1989 | Lalezari et al. | 343/767 |
| 4,853,704 | 8/1989 | Diaz et al. | 343/767 |
| 5,023,623 | 6/1991 | Kreinheder et al. | 343/770 |
| 5,081,467 | 1/1992 | Homer | 343/795 |

*Primary Examiner*—Rolf Hille
*Assistant Examiner*—Tan Ho
*Attorney, Agent, or Firm*—Irwin P. Garfinkle; Donald J. Singer

[57] ABSTRACT

A large antenna array is constructed in sub-arrays which are supported in a stacked and folded (stowed) condition, and then deployed by first unfolding and then expanding the stack. The sub-arrays are compressed together to yield a very compact stowed configuration, due to the absence of a continuous ground planes. The compressed sub-arrays are contained within a foldable cage like frame.

2 Claims, 4 Drawing Sheets

WIDE-BAND L-BAND CORPORATE FED ANTENNA FOR SPACE BASED RADARS

STATEMENT OF GOVERNMENT INTEREST

The invention described herein may be manufactured and used by or for the Government for governmental purposes without the payment of any royalty thereon.

BACKGROUND OF THE INVENTION

This invention relates to a deployable phased array antenna for a space based radar. The antenna is intended for deployment from a space shuttle which imposes volume limitations on the antenna, and therefore requires a configuration which can be folded and compressed into a relatively small compartment.

The antenna array for which this invention is provided is designed to have deployed dimensions of 86 feet by 149 feet, but when folded, it measures 8.5'×9.4'×27'. When folded, it fits conveniently into the 15'×30' payload volume of the space shuttles presently flown by the National Aeronautics and Space Administration.

In order to provide an array of such large dimensions, and yet be stowable in the relative small compartment of a space shutttle, this invention provides a plurality of antenna sub-arrays which permits the folding and storage of the antenna array, and the convenient deployment thereof.

In order to provide an antenna having the foregoing dimensions, it is necessary to use antenna elements that can be appropriately packaged. The tapered notch antenna, also known as a "Vivaldi" element, is disclosed in the copending application of Schnetzer, Ser. No. 07/644,176 now abandoned in favor of continuation application Ser No. 07/906,017 filed 26 Jun. 1992, entitled *TAPERED NOTCH ANTENNA USING COPLANAR WAVEGUIDE*. Schnetzer's Vivaldi tapered notch antenna was found to have many advantages in a folded, space based, phased array. First, since the Schnetzer antenna element uses no ground plane, the need for a continuous panel or membrane the size of the deployed antenna array is eliminated. Moreover, the antenna elements are printed on very thin dielectric substrates of Kapton, but sufficient stiffness is provided by the conductive metal remaining on the substrate.

In accordance with this invention, the antenna array is constructed in sub-arrays which are supported in a stacked and folded (stowed) condition, and then deployed by first unfolding and then expanding the stack. The sub-arrays are compressed together to yield a very compact stowed configuration, due to the absence of a continuous ground planes. The packed sub-arrays are contained within a cage like frame for launch restraint. This cage supports the RF feed network which feeds sixteen units of each sub-array. The feed network is made up of rigid suspended substrate suctions with flexible coaxial cable sections at the array hinge lines.

THE PRIOR ART

A patent search revealed the following prior art:

U.S. Pat. No. 4,482,900 issued to Bilek et al on 13 Nov. 1984. The Bilek et al patent discloses a foldable antenna which is stacked in a cube configuration.

U.S. Pat. No. 4,769,647 issued to Herbig et al on 6 Sep. 1988. The Herbig et al patent discloses a collapsible antenna array system having support ribs radially linked to the support body.

U.S. Pat. No. 4,843,403 issued to Lalezari et al on 27 Jun. 1989. The Lalezari et al patent discloses an antenna having broadband characteristics which employ dual notch radiating elements.

U.S. Pat. No. 4,853,704 issued to Diaz et al on 1 Aug. 1989. The Diaz patent discloses a notch antenna with microstrip feed.

DESCRIPTION OF THE DRAWINGS

For a clearer understanding of the nature and the objectives of this invention, reference should now be made to the following specification and to the accompanying drawings in which.

DESCRIPTION OF THE PREFERRED EMBODIMENT

Figure 1:
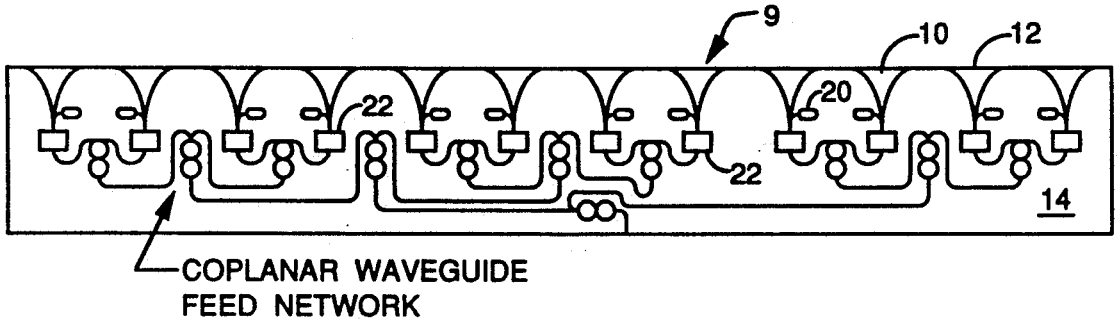
FIG. 1 shows a 12 element sub-array of Vivaldi tapered notch antennas.
Figure 2:
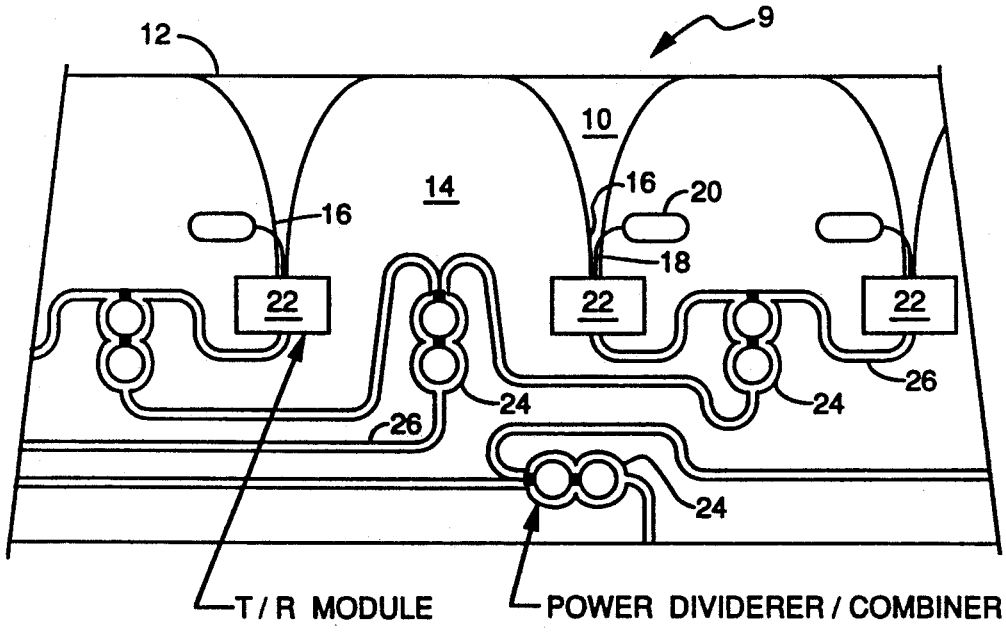
FIG. 2 is an enlargement of a broken away section of FIG. 1.

A preferred embodiment of the antenna array disclosed herein consists of many thousands of Vivaldi elements, arranged in a triangular lattice of stacks of 12 element sub-arrays. One such sub-array 9 is shown in FIGS. 1 and 2, and it consists of 12 Vivaldi tapered notch antennas 10 printed with copper 14 on a substrate 12 of Kapton or other very thin film dielectric material. In a practical system, there may be several thousand such sub-arrays. Each Vivaldi antenna 10 in sub-array 9 is fed by a section of slotline 16, which in turn is fed by a coplanar waveguide 18. The transition from the unbalanced coplanar waveguide terminates on the slotline conductor opposite the ground conductor of the coplanar waveguide. One slot of the coplanar waveguide becomes the feeding slotline for the notch, and the other slot terminates in a slotline open circuit.

All of the elements of the system coplanar. As noted in the co-pending application of Schnetzer, which is directed to the antenna elements, the sub-arrays 9 are printed by depositing a thin film of copper 14 on the substrate 12, and then photo-etching, or otherwise removing the copper from those areas which define the Vivaldi tapered notch antenna.

As best seen in FIG. 2, each antenna is fed with R.F. from a T/R module 22 which in turn is fed from a network comprising coplanar power dividers 24 and waveguides 26, all of which are made by removing copper from appropriate locations, as shown. Except for the T/R box 22, all of the elements of the sub-array 9 are coplanar. The T/R box 22 is a very thin element which adds very little thickness to the system.

The substrate 12 may be made of a dielectric material such a Kapton, or it may be made of a ceramic material PTFE composite, fiberglass reinforced with cross linked polyolefins, alumina and the like. Preferably, the antenna is made by electro-chemical deposition of copper on the entire substrate surface. Since only relatively small areas of copper conductor are removed, the copper provides important support of the very thin substrate.

It is noted that no ground plane is used behind the Vivaldi elements. This is important in that there is no need for a continuous panel or membrane the full size of the array. The Vivaldi element is relatively insensitive to out of flatness conditions and these attributes offer novel approaches for stowing and deploying the antenna arrays.

Figure 3:
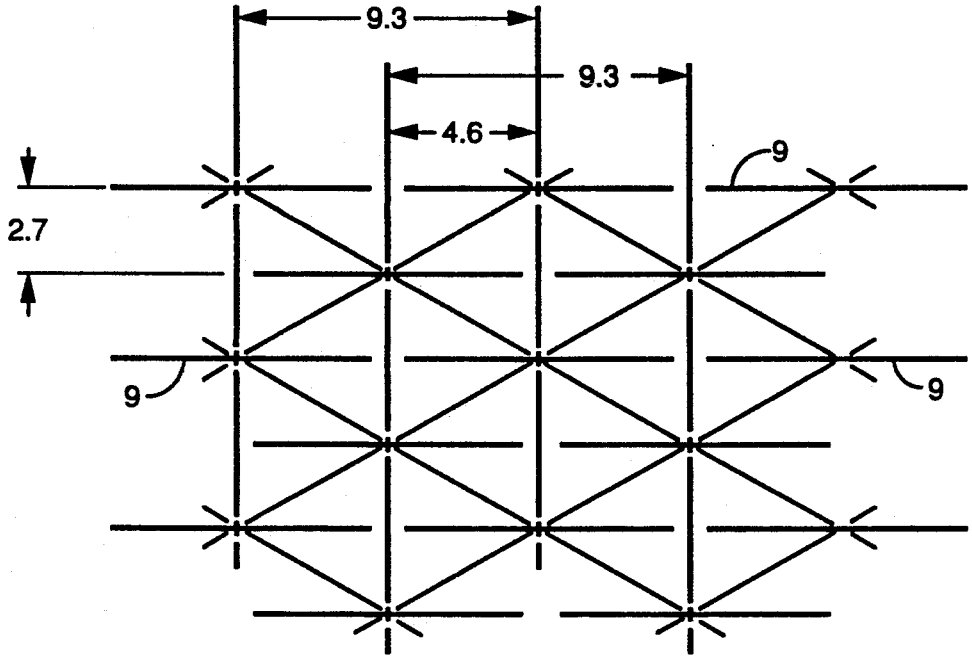
FIG. 3 shows the triangular array latice of the phased array antenna.
Figure 4:
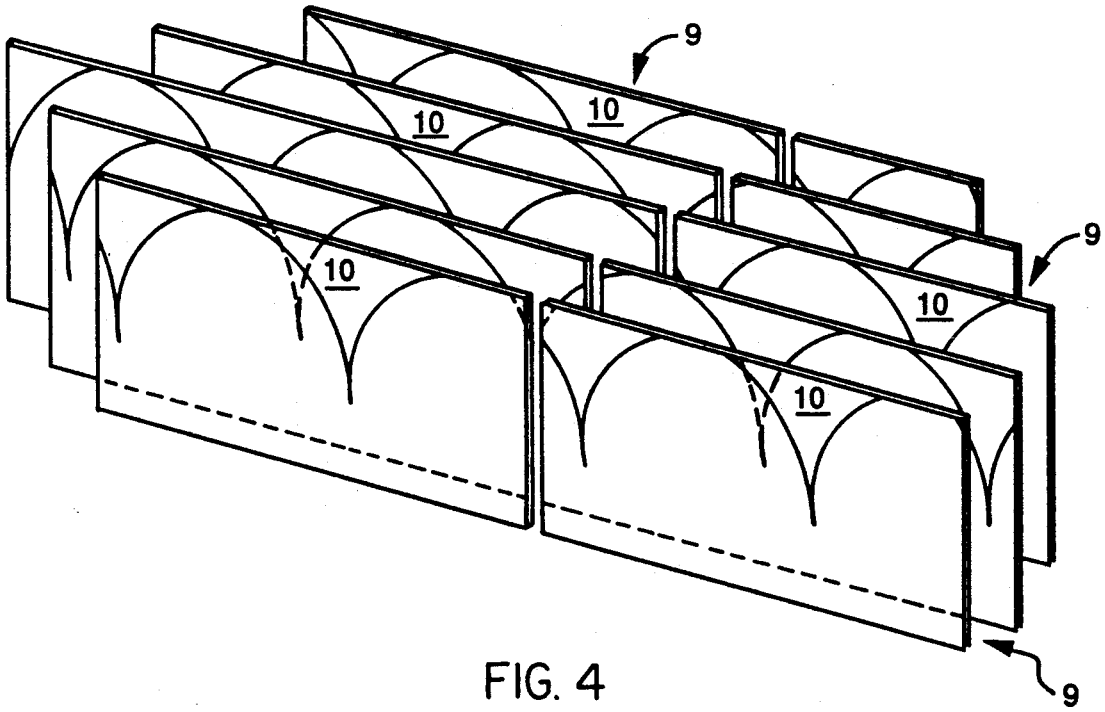
FIG. 4 is a perspective of the triangular array configuration.
Figure 5:
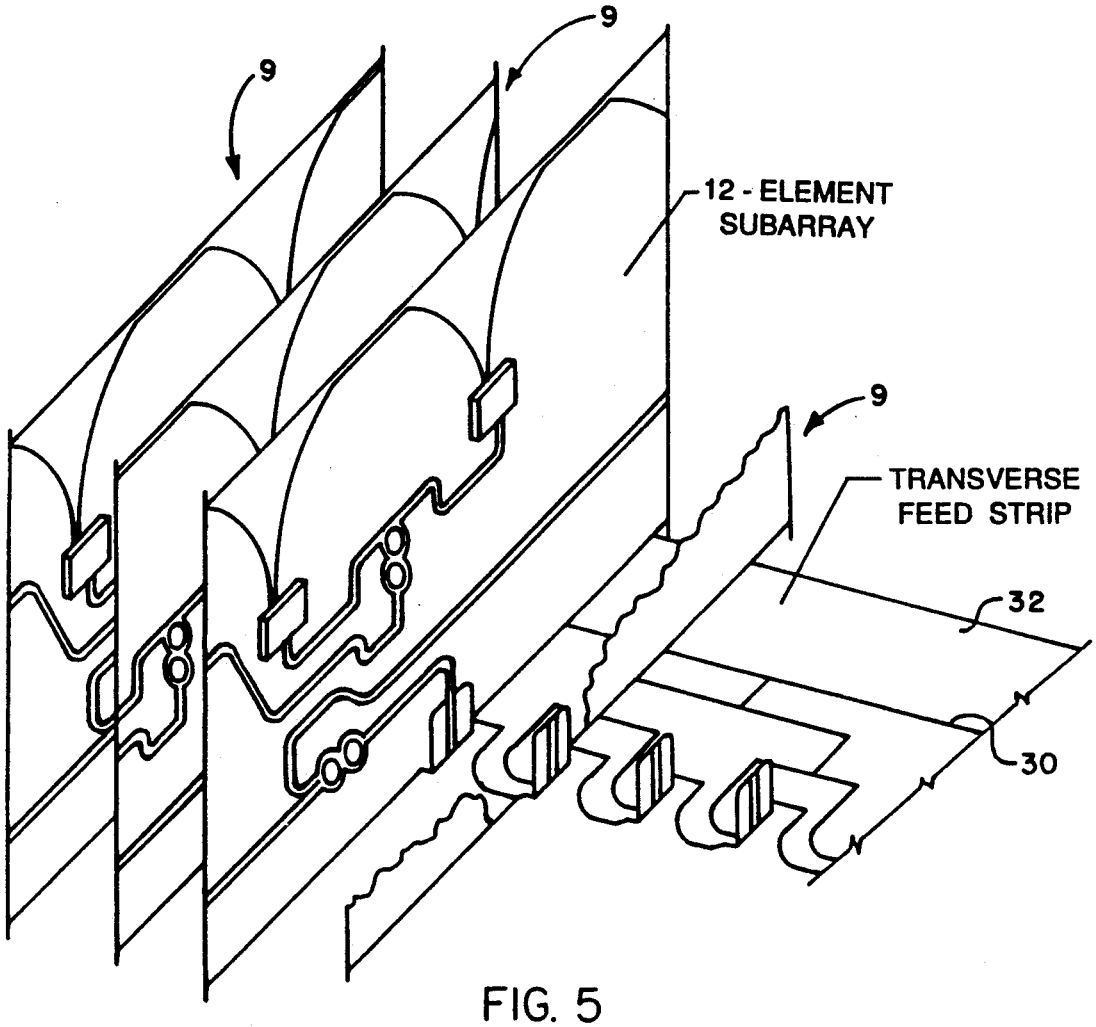
FIG. 5 is a perspective view which shows the mechanical and electrical connection between sub-arrays.
Figure 6:
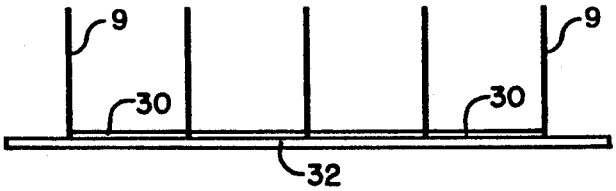
FIG. 6 is a schematic representation of the arrays after deployment.
Figure 7:
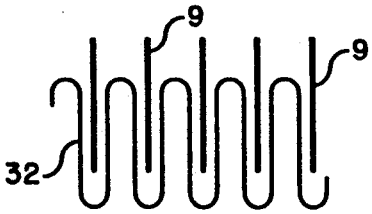
FIG. 7 is a schematic representation of the arrays in a compressed (stowed) state.

In constructing the antenna array, the sub-arrays of Vivaldi elements are preferably arranged in a triangular or staggered lattice, as shown in FIG. 4, and with dimensions as shown in FIG. 3. As shown in FIG. 5, the staggered sub-arrays 9 are stacked in parallel groups and are supplied through the feedlines 30 printed on a flexible transverse dielectric feed strip 32. As shown in FIG. 6, when the antenna array is deployed, the feed strips 32 are extended, but as shown in FIG. 7, when the arrays are stowed, the sub-arrays 9 are compressed together and the feed strip 32 is folded, thus providing for compact storage of the sub-arrays.

Figure 8:
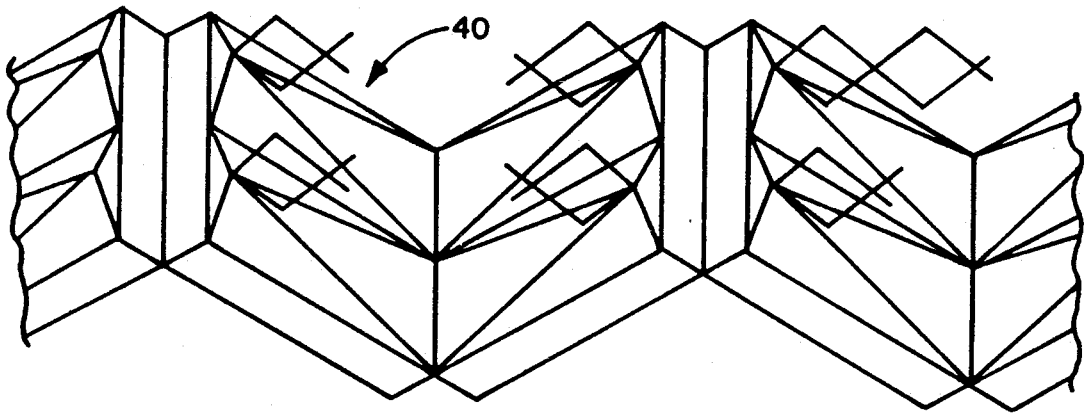
FIG. 8 a possible supporting structure for the arrays.

The compressed sub-arrays are housed in supporting structure which is expandable on deployment. While, the housing support forms no part of this invention, it is anticipated that antenna arrays will be housed in multiple containers 40, that will be hinged together as shown in FIG. 8. In addition to its ability to unfold, the structure must also be expandable in a direction transverse to the sub-arrays, to provide for their deployment.

While one preferred embodiment of this invention has been disclosed, it is intended that this invention be limited only by the appended claims as read in the light of the prior art.

What is claimed is:

1. In a collapsible antenna array having no ground plane, the combination comprising:

a plurality of planar sub-arrays, each of said sub-arrays comprising an elongated, thin, flexible substrate having a plurality of antenna elements printed thereon;

a feed strip comprising a second flexible substrate having feedlines thereon for supplying R.F. energy to said antenna elements of said sub-arrays, said sub-arrays being mounted in spaced parallel relationship on said second substrate, said second substrate being foldable when said sub-arrays are compressed in a direction transverse to said parallel relationship, whereby said antenna array can be stored in a compressed state.

2. The antenna array of claim 1 in which said feedlines for supplying said R.F. energy to said antenna elements are printed on said second flexible substrate, and said second substrate is comprised of a dielectric material.

* * * * *